US008041287B2

(12) United States Patent
Fukuda

(10) Patent No.: US 8,041,287 B2
(45) Date of Patent: Oct. 18, 2011

(54) IMAGE FORMING APPARATUS INCLUDING AN ATTACHABLE AND DETACHABLE BOTH-FACE PRINTING DEVICE

(75) Inventor: Takehiro Fukuda, Kashiwazaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 690 days.

(21) Appl. No.: 11/872,805

(22) Filed: Oct. 16, 2007

(65) Prior Publication Data

US 2008/0187380 A1 Aug. 7, 2008

(30) Foreign Application Priority Data

Nov. 30, 2006 (JP) ..... 2006-323460

(51) Int. Cl.
*G03G 15/00* (2006.01)

(52) U.S. Cl. ..... 399/401; 399/110; 399/107

(58) Field of Classification Search ..... 399/401, 399/110, 107; 271/301, 3.18, 3.19, 3.2, 291
See application file for complete search history.

(56) References Cited

U.S. PATENT DOCUMENTS 5,815,772 A * 9/1998 Saito et al. ..... 399/107
5,839,032 A * 11/1998 Yasui et al. ..... 399/124

FOREIGN PATENT DOCUMENTS

JP 2002-145537 A 5/2002

* cited by examiner

*Primary Examiner* — Matthew G Marini
(74) *Attorney, Agent, or Firm* — Sughrue Mion, PLLC

(57) ABSTRACT

An image forming apparatus includes: an image forming apparatus main body; an image forming section that is arranged within the image forming apparatus main body, and that forms an image in a recording medium; a discharging member that discharges the recording medium on which the image is formed by the image forming section; a driving source that normally and reversely rotates the discharging member; and a both-face printing assembly body that returns the recording medium pulled-back by reversely rotating the discharging member to the image forming section, the driving source and the both-face printing assembly body being separately freely attached and detached with respect to the image forming apparatus main body.

15 Claims, 11 Drawing Sheets

IMAGE FORMING APPARATUS INCLUDING AN ATTACHABLE AND DETACHABLE BOTH-FACE PRINTING DEVICE

CROSS-REFERENCE TO RELATED APPLICATIONS

This application is based on and claims priority under 35 U.S.C. 119 from Japanese Patent Application No. 2006-323460 filed Nov. 30, 2006.

BACKGROUND

1. Technical Field

The present invention relates to an image forming apparatus such as a printer, a copying machine, a facsimile, etc.

2. Related Art

In the image forming apparatus of this kind, the following structure is known. In this structure, an inversion conveyance assembly body in which a recording medium once discharged by normal rotation of a discharging member until an intermediate portion is again taken-in and conveyed by reverse rotation of the discharging member, is freely mounted. In a first driving path for normally rotating the discharging member, transmission of driving force of the above driving source to the above discharging member is interrupted by mounting the inversion conveyance assembly body. The above inversion conveyance assembly body has a second driving path for transmitting the driving force of the driving source to the discharging member so as to be freely rotated normally and reversely.

SUMMARY

According to an aspect of the present invention, an image forming apparatus including: an image forming apparatus main body; an image forming section that is arranged within the image forming apparatus main body, and that forms an image in a recording medium; a discharging member that discharges the recording medium on which the image is formed by the image forming section; a driving source that normally and reversely rotates the discharging member; and a both-face printing assembly body that returns the recording medium pulled-back by reversely rotating the discharging member to the image forming section, the driving source and the both-face printing assembly body being separately freely attached and detached with respect to the image forming apparatus main body.

BRIEF DESCRIPTION OF THE DRAWINGS

Exemplary embodiment of the present invention will be described in detail based on the following figures, wherein.

DETAILED DESCRIPTION

An embodiment mode of the present invention will next be explained. The following explanation is merely one example in executing the present invention, and the present invention is not limited to matters explained below, but can be suitably changed in accordance with necessity.

Figure 1:
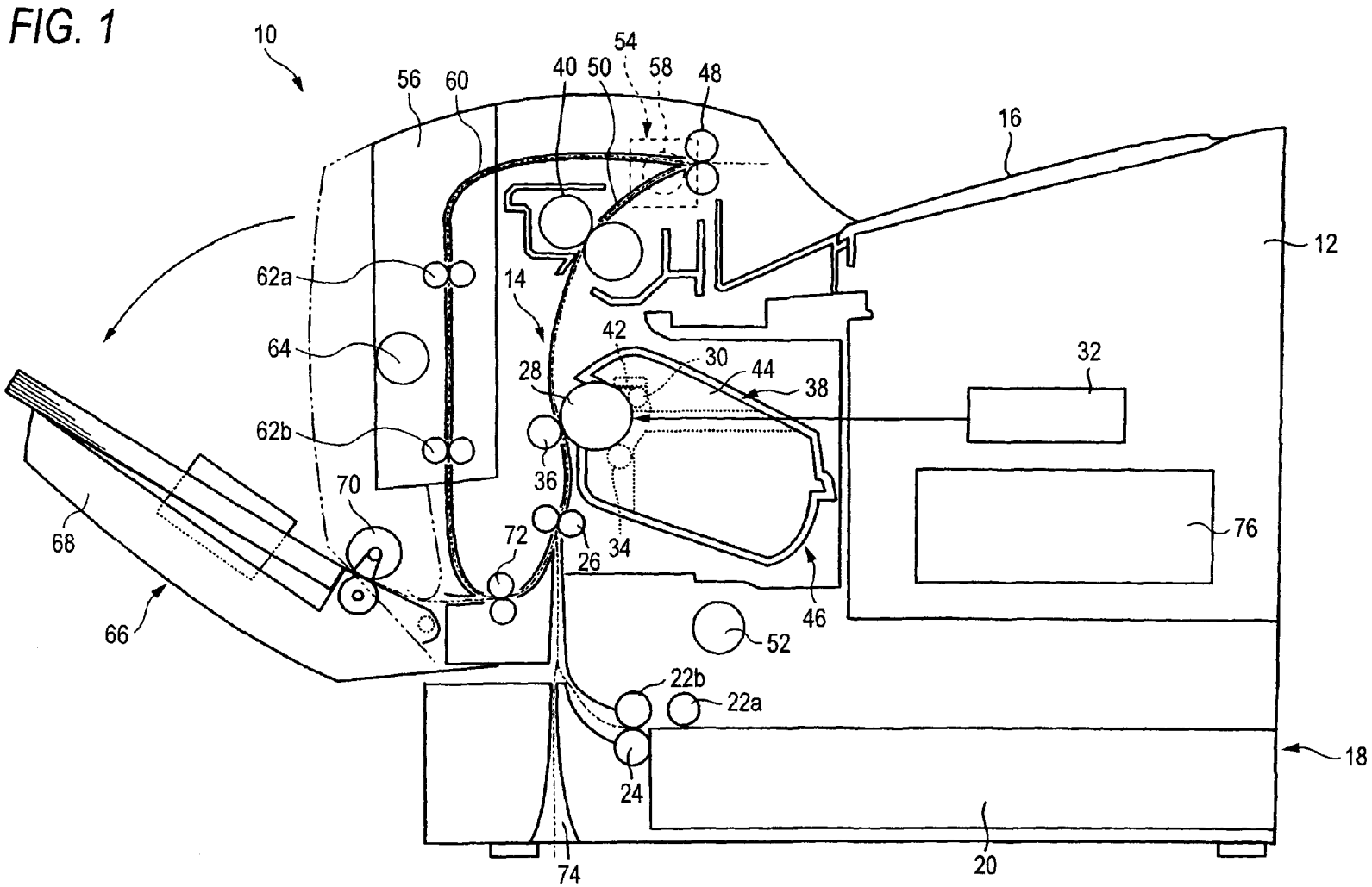
FIG. 1 is a side view showing a state adding a both-face printing function in an image forming apparatus in accordance with a first embodiment mode of the present invention.
Figure 2:
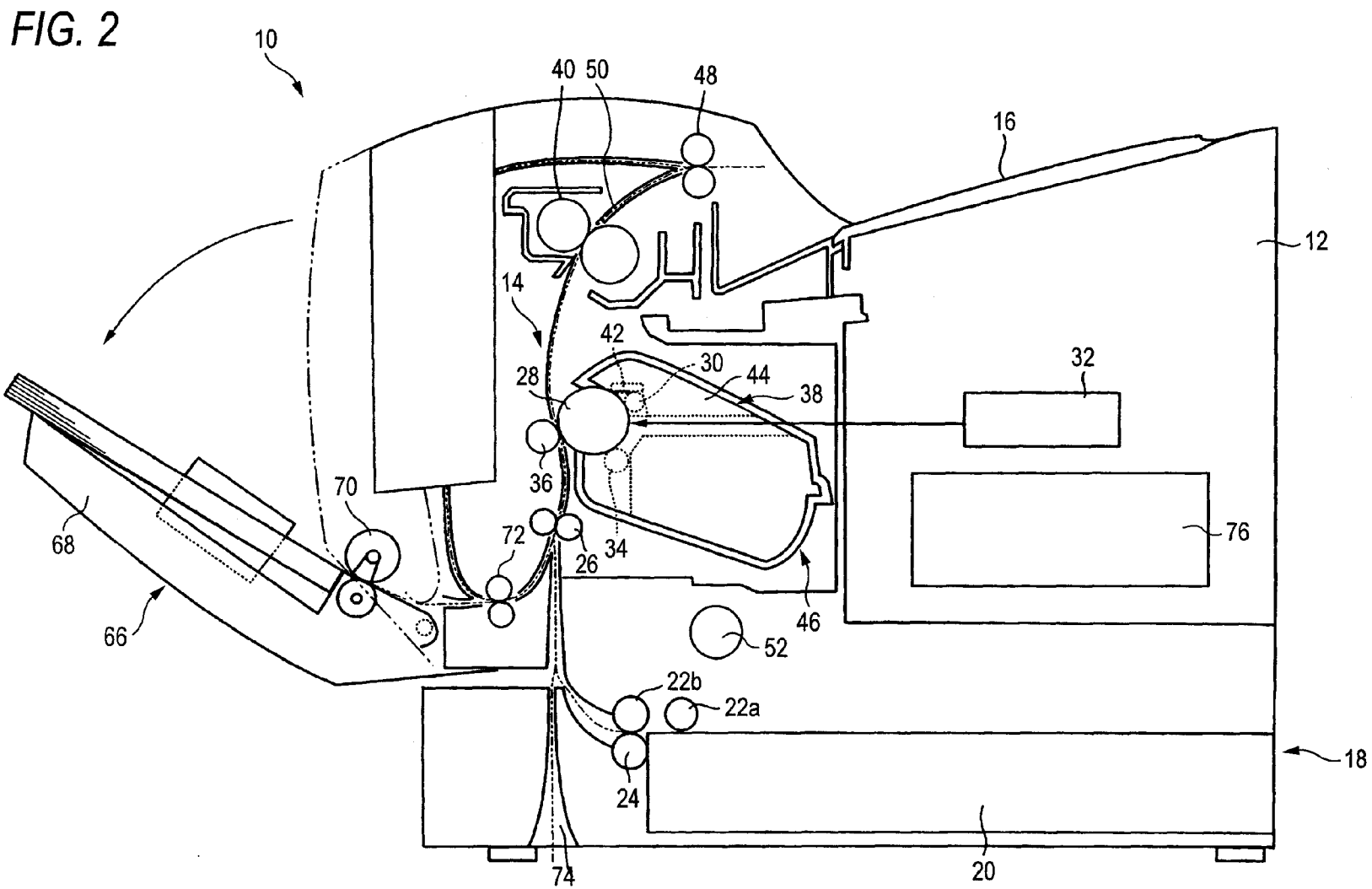
FIG. 2 is a side view showing a state of a basic construction in the image forming apparatus in accordance with the first embodiment mode of the present invention.

In FIGS. 1 and 2, an image forming apparatus 10 has an image forming apparatus main body 12, and an image forming section 14 is arranged within this image forming apparatus main body 12. Further, a discharging portion 16 is arranged in an upper portion of this image forming apparatus main body 12. A paper feed assembly body 18 is arranged in a lower portion of this image forming apparatus main body 12.

The paper feed assembly body 18 has a paper feed cassette 20 for storing a recording medium and arranged in the image forming apparatus main body 12 so as to be freely pulled out. Further, this paper feed assembly body 18 has paper feed members 22*a*, 22*b* and a handling member 24. The recording medium stacked on the paper feed cassette 20 is separated and fed to a resist member 26 by cooperation of these paper feed members 22*a*, 22*b* and the handling member 24.

For example, the image forming section 14 is of an electrophotographic type, and is constructed by an image holding body 28 formed by a photosensitive body, a charging device 30, an optical writing device 32, a developing device 34, a transfer device 36, a cleaning device 38 and a fixing device 40. For example, the charging device 30 is constructed by a charging roll for uniformly charging this image holding body 28. The optical writing device 32 writes a latent image to the image holding body 28 charged by this charging device 30 by light. The developing device 34 visualizes the latent image of the image holding body 28 formed by this optical writing device 32. The transfer device 36 transfers a developing agent image using the developing device 34 to the recording medium. The cleaning device 38 cleans the developing agent left in the image holding body 28. The fixing device 40 fixes the developing agent image on the recording medium transferred by the transfer device 36 to the recording medium, and is constructed by e.g., a pressurizing roll and a heating roll. For example, the optical writing device 32 is constructed by a laser exposing device of a scanning type, and crosses the interior of a process cartridge 46 and forms the latent image in the image holding body 28. The cleaning device 38 has a cleaning blade 42 coming in contact with the image holding body 28 and also has a developing agent collecting portion 44 for storing the developing agent scraped off by this cleaning blade 42. The optical writing device 32 can use a LED, a face light emitting laser, etc. as another embodiment mode.

In the process cartridge 46, the image holding body 28, the charging device 30, the developing device 34 and the cleaning device 38 are integrated, and these members can be integrally exchanged.

A main conveying path 50 reaching the discharging portion 16 through a portion between the image holding body 28 and the transfer device 36, the fixing device 40 and a discharging member 48 is formed on a rear flow side of the resist member 26. When one face printing is designated in the image forming apparatus 10, the recording medium sent out of the paper feed cassette 20 of the paper feed assembly body 18 by the paper feed members 22*a*, 22*b* is temporarily stopped by a resist member 24 and is conveyed to the main conveying path 50 by taking timing. A developing agent image is formed on one face by passing a portion between the image holding body 28 and the transfer device 36. The developing agent image is then fixed by the fixing device 40, and is discharged to the discharging portion 16 by normal rotation of the discharging member 48.

A first driving source 52 constructed by e.g., a motor is arranged within the image forming apparatus main body 12 and is connected to the conveying members 22*a*, 22*b*, the image holding body 28, the charging device 30, the developing device 34, the transfer device 36 and the fixing device 40 through e.g., a gear series, and operates these members. Further, at a basic construction time shown in FIG. 2, the first driving source 52 is connected to the discharging member 48, and normally rotates and operates the discharging member 48 (rotation of a direction for discharging the recording medium).

A driving source assembly body 54 and a both-face printing assembly body 56 are separately attached and detached with respect to the image forming apparatus main body 12, and are mounted to the image forming apparatus main body 12 in a state adding a both-face printing function shown in FIG. 1. In the state of the basic construction shown in FIG. 2, the driving source assembly body 54 and the both-face printing assembly body 56 are detached, and only a substitute box body portion is arranged in the image forming apparatus main body 12.

The driving source assembly body 54 has a second driving source 58 constructed by e.g., a motor, and this second driving source 58 can be rotated normally and reversely, and normally and reversely operates the discharging member 48.

In the both-face printing assembly body 56, one portion of an inversion path 60 is formed and conveying members 62*a*, 62*b* for both-face printing are arranged. The inversion path 60 is formed so as to be branched from the main conveying path 50 before the discharging member 48 and be returned until the resist member 24. Further, the both-face printing assembly body 56 has a third driving source 64 constructed by e.g., a motor. This third driving source 64 is connected to the conveying members 62*a*, 62*b* for both faces and operates these conveying members 62*a*, 62*b* for both faces in an inverting direction.

Further, a hand assembly 66 is arranged on a front face (a left-hand side face of FIGS. 1 and 2) of the image forming apparatus main body 12 so as to be freely opened and closed with respect to the image forming apparatus main body 12. A hand storing portion 68 for storing the recording medium and a hand sending-out member 70 are arranged in this hand assembly 66. A paper sheet stored to the hand storing portion 68 is sent out by rotating this hand sending-out member 70. A rear flow side of the hand sending-out member 70 is connected to the inversion path 60, and a conveying member 72 of a hand both-face combined use is arranged in its connecting portion.

When both-face printing is performed, the discharging member 48 is reversely rotated (rotation of a direction for pulling-in the recording medium) at a time point at which this side of a rear end of the recording medium reaches the discharging member 48. The recording medium is then pulled back and is guided to the inversion path 60. The recording medium is conveyed along the inversion path 60 by the conveying members 62*a*, 62*b* for both faces and the conveying member 72 for both faces and a hand until the recording medium hits against the resist member 24. The recording medium is temporarily stopped by the resist member 24, and is conveyed to the main conveying path 50 by taking timing. A developing agent image is then formed on the remaining one face by passing a portion between the image holding body 28 and the transfer device 36. The developing agent image is fixed by the fixing device 40, and is discharged to the discharging portion 16 by normal rotation of the discharging member 48.

Here, a circumferential speed of a reverse rotation direction of the discharging member 48 using the second driving source 58 is set to be faster than the circumferential speed of a normal rotation direction of the discharging member using the first driving source 52 or the second driving source 58 at an absolute value. A conveying speed V1 of the recording medium in a pulling-back case of the recording medium is faster than a conveying speed V2 of the recording medium in a discharging case of the recording medium. Therefore, the recording medium can be rapidly pulled-in.

Further, the conveying speed V1 of the reverse rotating direction of the recording medium conveyed by operating the second driving source 58 through the discharging member 48 is set to be faster than a conveying speed V3 of the recording medium conveyed by operating the above third driving source 64 through the conveying members 62*a*, 62*b* for both faces. When the recording medium is delivered to the conveying members 62*a*, 62*b* for both faces from the discharging member 48, tensile force is set not to be applied to the recording medium.

A recording medium conveying path 74 is arranged in the above paper feed cassette 20. When plural paper feed cassettes are overlapped and arranged at many stages, the recording medium supplied by another paper feed cassette arranged on the lower side is conveyed by this recording medium conveying path 74. Further, a driving control section 76 for controlling operations of the first driving source 52, the second driving source 58, the third driving source 64, etc. is arranged within the image forming apparatus main body 12.

A driving mechanism of the discharging member 48 will next be explained.

Figure 3:
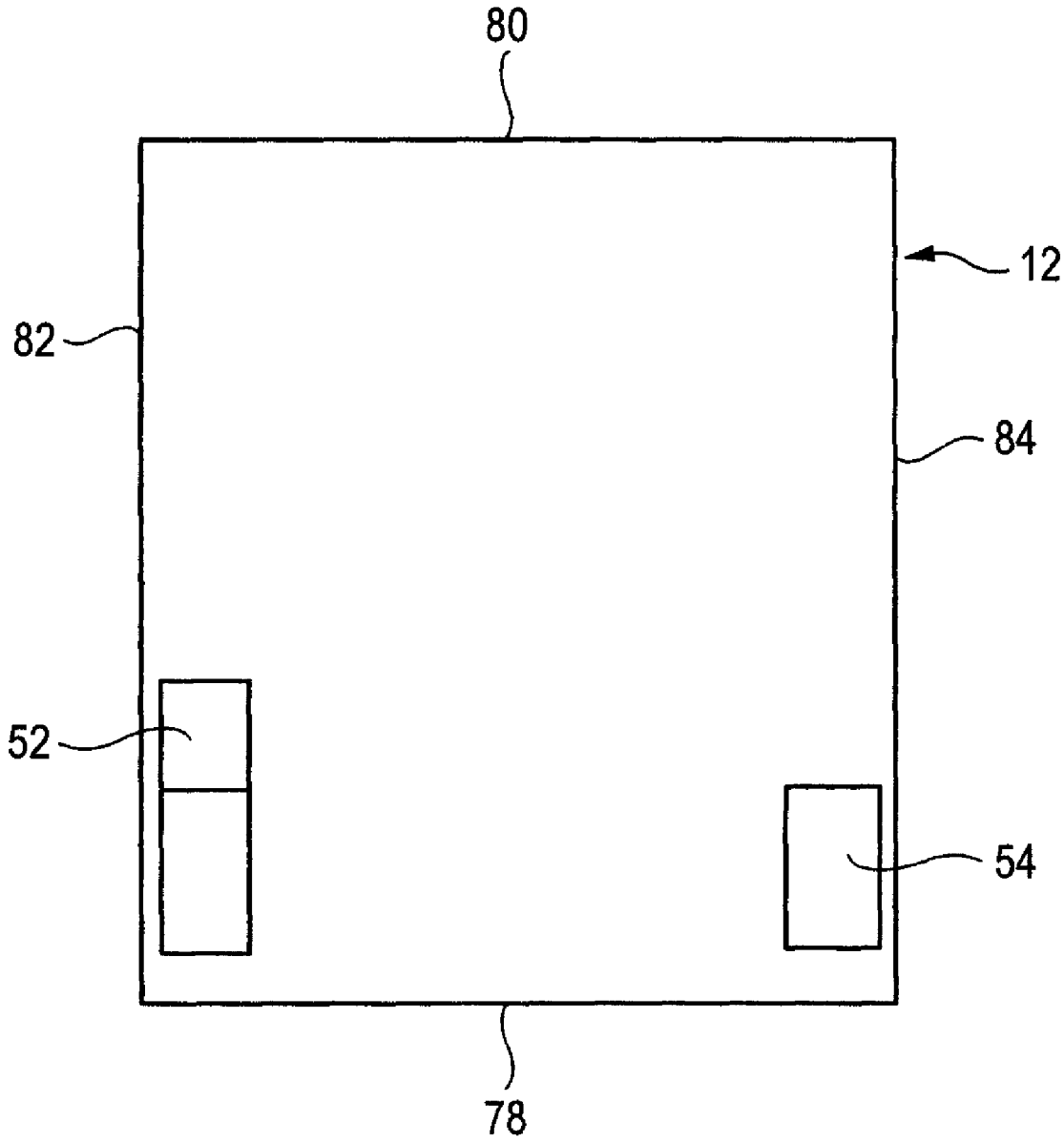
FIG. 3 is a plan view showing the image forming apparatus in accordance with the first embodiment mode of the present invention.
Figure 4:
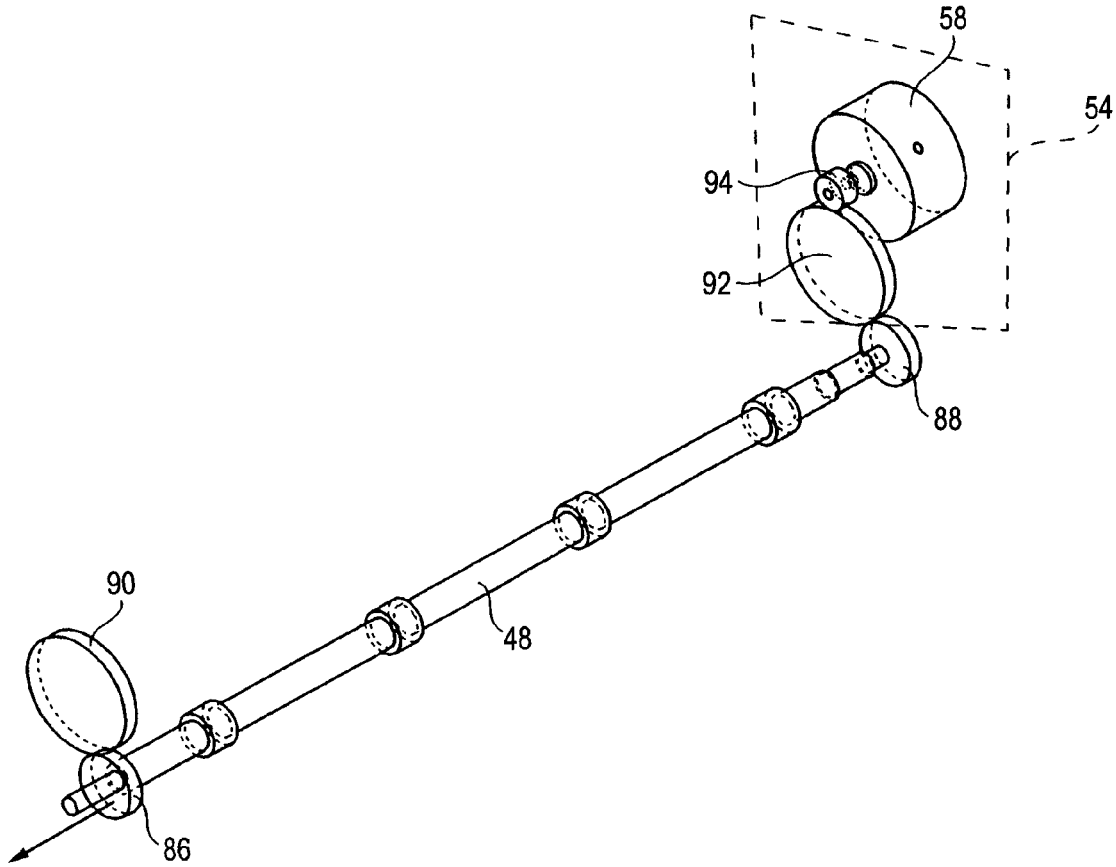
FIG. 4 is a perspective view showing a driving mechanism of a discharging member in the image forming apparatus in accordance with the first embodiment mode of the present invention.
Figure 5:
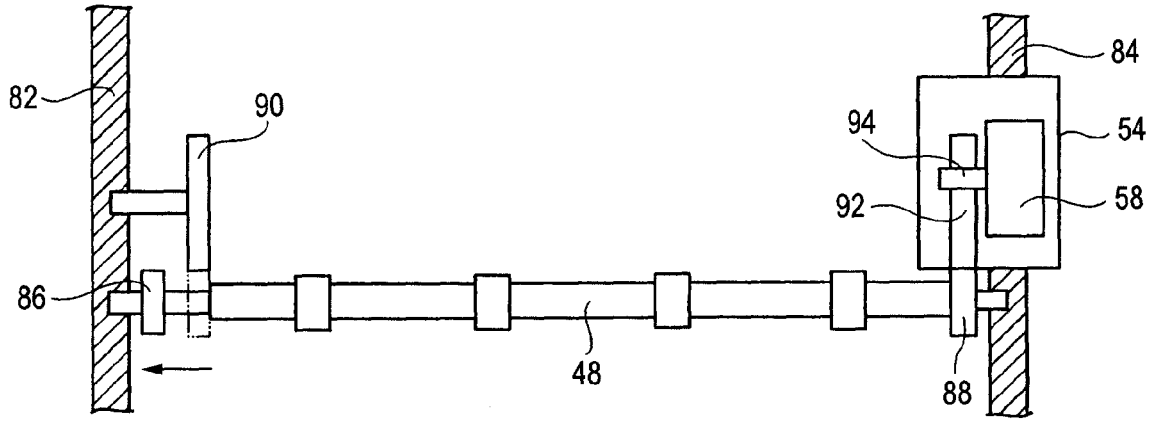
FIG. 5 is a cross-sectional view showing the driving mechanism of the discharging member in the image forming apparatus in accordance with the first embodiment mode of the present invention.

FIGS. 3 to 5 show the first embodiment mode in the present invention.

In FIG. 3, the image forming apparatus main body 12 has a front face 78, a rear face 80, a first side face 82 and a second side face 84. The first side face 82 and the second side face 84 connect the front face 78 and the rear face 80, and are arranged so as to be opposed to each other.

The above first driving source 52 is arranged on e.g., the first side face 82 side, and the driving source assembly body 54 is arranged on the second side face 84 side. The "side face side" shows a state shifted on one side from the center between the first side face 82 and the second side face 84.

As shown in FIGS. 4 and 5, in the discharging member 48, a first driven gear 86 and a second driven gear 88 are arranged on both sides of the discharging member 48. The first driven gear 86 is freely moved in only an axial direction. When the first driven gear 86 is located in a position shown by a two-dotted chain line of FIG. 5, the first driven gear 86 is engaged with a first driving gear 90 as a gear of a final stage of a first driving source. When the first driven gear 86 is located in a position shown by a solid line of FIG. 5, the engagement with the first driving gear 90 is released. For example, the axial movement of the first driven gear 86 is manually made.

The second driven gear 88 is fixed to the discharging member 48 and is engaged with a second driving gear 92 arranged in the driving source assembly body 54. The driving source assembly body 54 is constructed by engaging the second driving gear 92 with an output gear 94 of the second driving source 58.

In the case of the basic construction shown in FIG. 2, the driving source assembly body 54 is not mounted to the image forming apparatus main body 12, and the first driving source 52 and the first driven gear 86 are connected, and the discharging member 48 is rotated only normally. When a both-face printing function shown in FIG. 1 is added from this state, the first driven gear 86 is moved in the axial direction and the engagement with the first driving gear 90 is released. Further, the driving source assembly body 54 is mounted to the image forming apparatus main body 12, and the second driven gear 88 and the second driving gear 92 are engaged. Thus, the discharging member 48 can be rotated normally and reversely.

Figure 6:
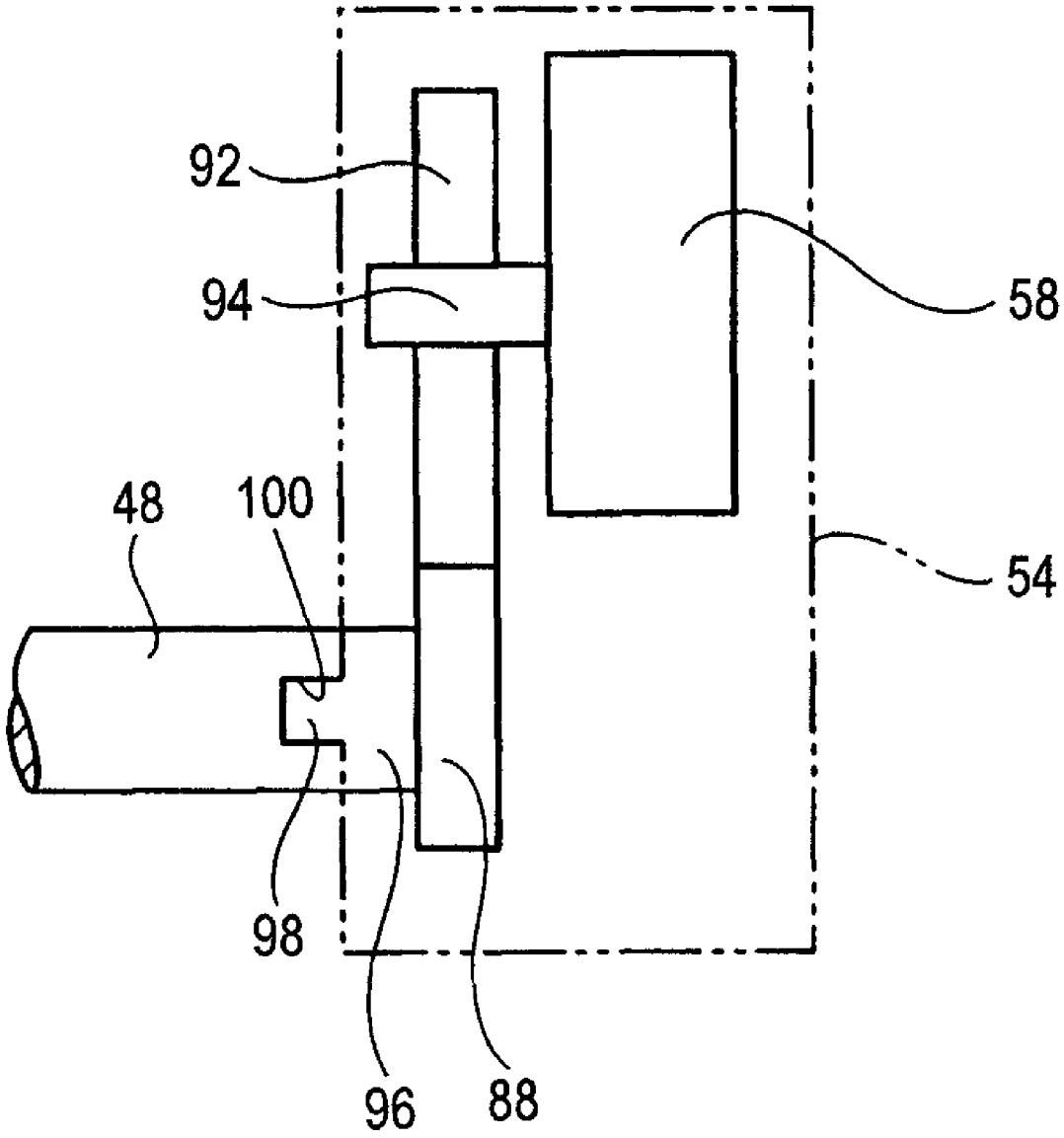
FIG. 6 is a plan view showing a driving mechanism of a discharging member in an image forming apparatus in accordance with a second embodiment mode of the present invention.

FIG. 6 shows a second embodiment mode in the present invention. In the above first embodiment mode, the driving source assembly body 54 is constructed from the second driving source 54 and the second driving gear 92. In contrast to this, in this second embodiment mode, the driving source assembly body 54 includes a second driven gear 88 and a coupling portion 96 in addition to the second driving source 54 and the second driving gear 92. The driven gear 88 and the coupling portion 96 are fixed, and an engaging portion 98 is formed in the coupling portion 96 so as to be projected in the axial direction. On the other hand, an engaged portion 100 formed in a concave shape is arranged at one end of the discharging member 48, and an engaging portion 98 of the coupling portion 96 is engaged with this engaged portion 100. Accordingly, in the driving source assembly body 54 in this embodiment mode, the second driving source 54, the second driving gear 92, the second driven gear 88 and the coupling portion 96 can be integrally attached and detached with respect to the image forming apparatus main body 12.

Figure 7:
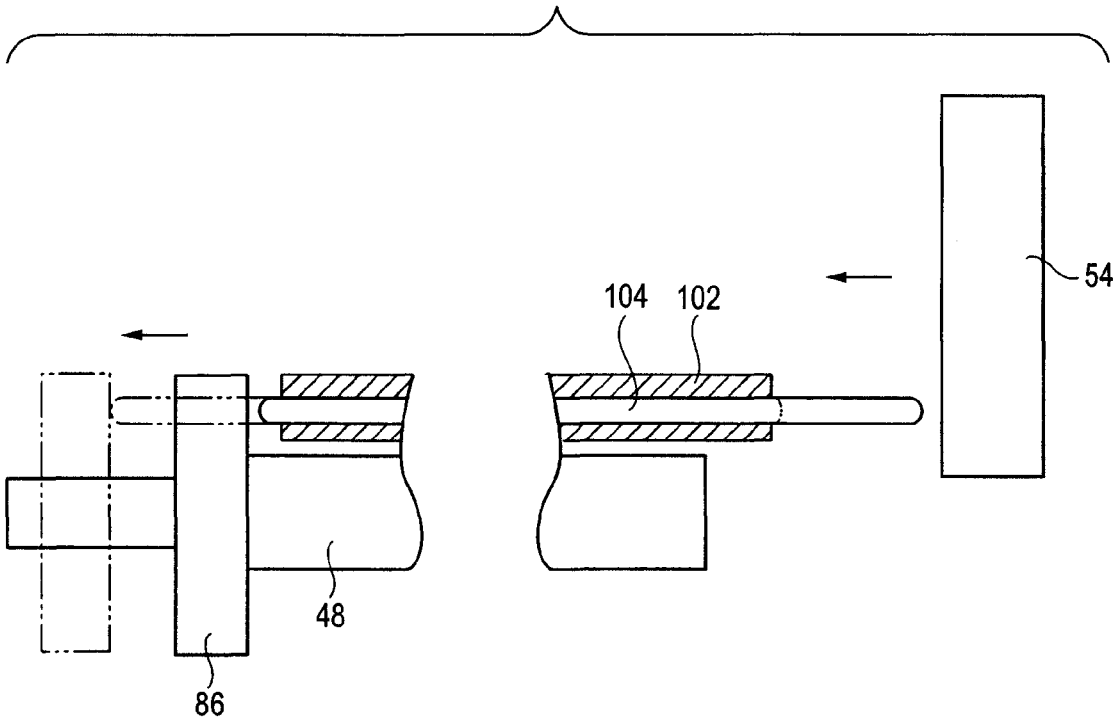
FIG. 7 is a cross-sectional view showing a driving mechanism of a discharging member in an image forming apparatus in accordance with a third embodiment mode of the present invention.

A third embodiment mode in the present invention is shown in FIG. 7. In the above first embodiment mode, the first driven gear 86 is constructed so as to be manually moved. However, in this third embodiment mode, the first driven gear 86 can be moved in association with attachment and detachment of the driving source assembly body 54. Namely, a pressing bar 104 as a switching means is slidably inserted into a sleeve 102 fixed to the image forming apparatus main body 12 so as to be parallel to the discharging member 48. When the driving source assembly body 54 is mounted to the image forming apparatus main body 12, one end of the pressing bar 104 is pressed by the driving source assembly body 54. Thus, as shown by a two-dotted chain line of FIG. 7, the other end of the pressing bar 104 presses against the first driven gear 86 and moves the first driven gear 86 in the axial direction of the discharging member 48, and releases engagement of the first driven gear 86 and the first driving gear 90.

Figure 8:
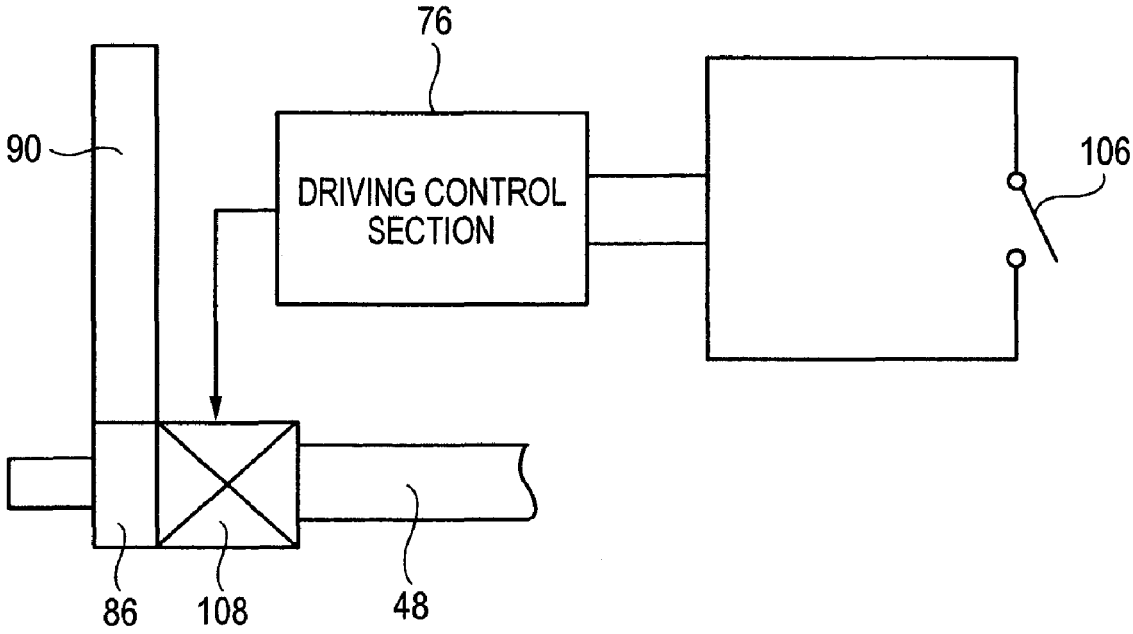
FIG. 8 is a schematic view showing a driving mechanism of a discharging member in an image forming apparatus in accordance with a fourth embodiment mode of the present invention.

A fourth embodiment mode in the present invention is shown in FIG. 8. In the above third embodiment mode, the switching means is mechanically constructed. In contrast to this, in this fourth embodiment mode, the switching means is electrically constructed. Namely, a detecting switch 106 turned on and off in association with attachment and detachment of the driving source assembly body 54 is connected to a driving control section 76. An electromagnetic clutch 108 arranged between the discharging member 48 and the first driven gear 86 is turned on and off in accordance with a detecting result of this detecting switch 106. When the driving source assembly body 54 is mounted, the detecting switch 106 is turned on and the electromagnetic clutch 108 is turned off by the driving control section 76. Even when the first driving gear 90 is rotated, the first driven gear 86 runs idle and no driving force from the first driving source 52 is transmitted to the discharging member 48. Accordingly, since only driving force from the second driving source 58 of the driving source assembly body 54 is transmitted in the discharging member 48, the discharging member 48 can be rotated normally and reversely.

Figure 9:
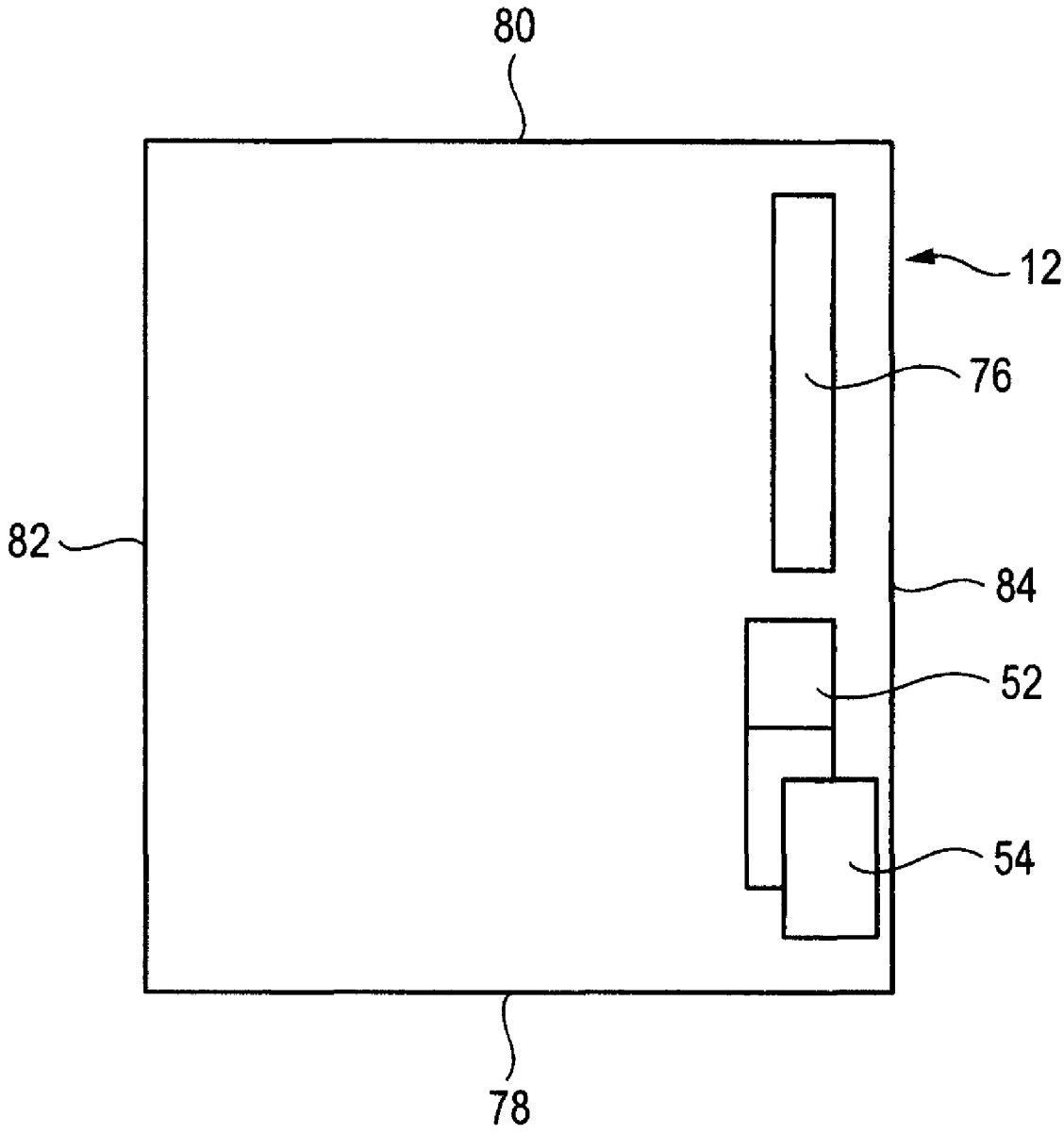
FIG. 9 is a plan view showing an image forming apparatus in accordance with a fifth embodiment mode of the present invention.
Figure 10:
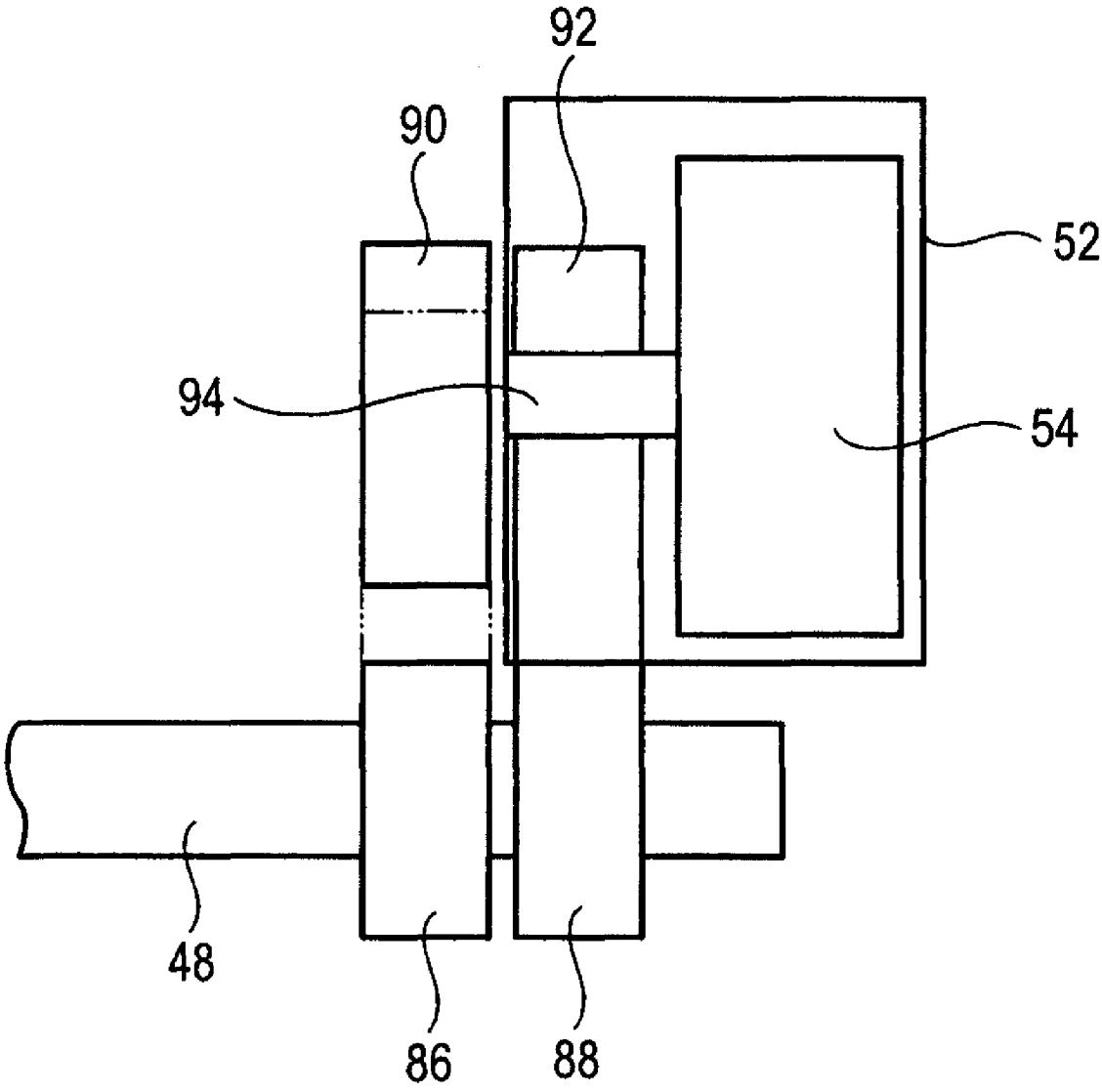
FIG. 10 is a plan view showing a driving mechanism of a discharging member in the image forming apparatus in accordance with the fifth embodiment mode of the present invention.
Figure 11:
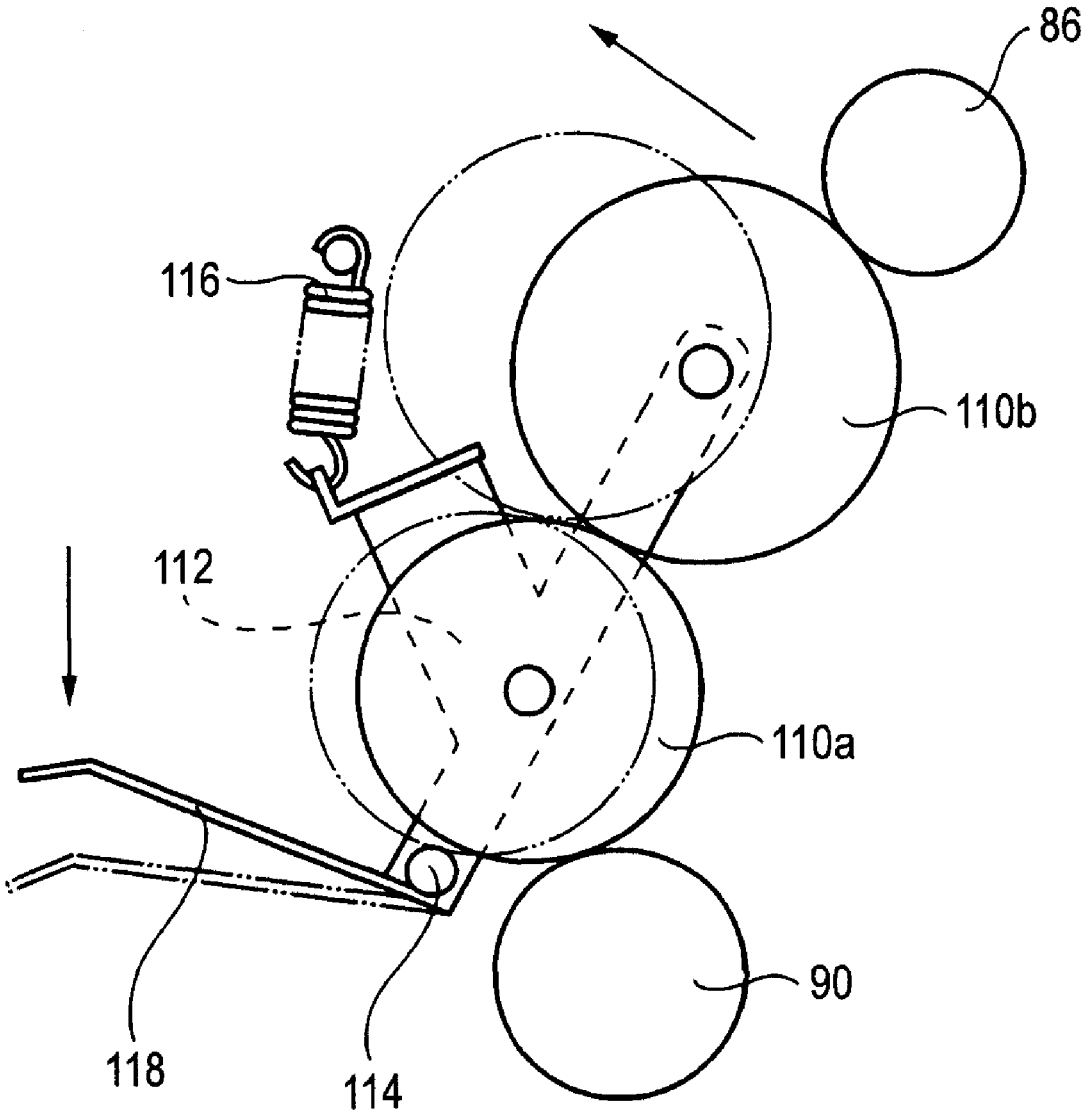
FIG. 11 is a side view showing the driving mechanism of the discharging member in the image forming apparatus in accordance with the fifth embodiment mode of the present invention.

FIGS. 9 to 11 show a fifth embodiment mode in the present invention. In the above first embodiment mode, the first driving source 52 and the driving source assembly body 54 are arranged on both side face sides of the image forming apparatus main body 12. In contrast to this, in this fifth embodiment mode, as shown in FIG. 9, for example, the first driving source 52 and the driving source assembly body 54 are arranged on the second side face 84 side. Further, the driving control section 76 is arranged on this second side face 84 side. This driving control section 76, the first driving source 52 and the driving source assembly body 54 can be wired on the same side face side.

The second driven gear 88 is fixed to one end of the discharging member 48 in parallel with the first driven gear 86. At a basic constructing time of the image forming apparatus, the first driven gear 86 is engaged with the first driving gear 90 connected to the first driving source 52. When the driving source assembly body 54 is mounted to the image forming apparatus main body 12 from this state, as shown in FIG. 10, the second driving gear 92 of the driving source assembly body 54 is engaged with the second driven gear 88, and engagement of the first driven gear 86 and the first driving gear 90 is released.

In this fifth embodiment mode, as shown in FIG. 11, for example, two connecting gears 110*a*, 110*b* are interposed between the first driving gear 90 and the first driven gear 86. These connecting gears 110*a*, 110*b* are rotatably supported in a support member 112. This support member 112 is supported in the image forming apparatus main body 12 through a fulcrum 114. Further, a biasing member 116 is connected to this support member 112, and the connecting gears 110*a*, 110*b* are biased by this biasing member 116 in a direction engaged with the first driving gear 90 and the first driven gear 86. Further, a lever portion 118 is arranged slightly toward an upward direction from the horizontal direction in the support member 112. When the driving source assembly body 54 is mounted, the lever portion 118 is pressed toward a downward direction from the driving source assembly body 54. When the lever portion 118 is pressed toward the downward direction, the support member 112 is rotated in the counterclockwise direction with the fulcrum 114 as a center, and the connecting gears 110*a*, 110*b* are separated from the first driving gear 90 and the first driven gear 86, and connection of the first driving gear 90 and the first driven gear 86 is interrupted.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image forming apparatus main body;

an image forming section that is arranged within the image forming apparatus main body, and that forms an image in a recording medium;

a discharging member that discharges the recording medium on which the image is formed by the image forming section;

a first driving source that normally rotates the discharging member;

a second driving source that normally and reversely rotates the discharging member; and a both-face printing assembly body that returns the recording medium pulled-back by reversely rotating the discharging member to the image forming section, wherein the both-face printing assembly body is freely attached and detached with respect to the image forming apparatus main body, and the driving source is freely attached and detached with respect to both the image forming apparatus main body and the both-face printing assembly body, and wherein the discharging member comprises an engaging portion, the engaging portion adjustably disposed at a first position and a second position along an axial direction of the discharging member, the engaging portion disengaged from the second driving source and engaged with the first driving source at the first position when the second driving source is detached from the image forming apparatus main body and the engaging portion engaged with the second driving source and disengaged from the first driving source at the second position when the second deriving source is attached to the image forming apparatus main body.

2. An image forming apparatus comprising:

an image forming apparatus main body;

an image forming section that is arranged within the image forming apparatus main body, and that forms an image in a recording medium;

a first driving source that is arranged within the image forming apparatus main body;

a discharging member that is rotated in a normal direction by the first driving source, and that discharges the recording medium on which the image is formed by the image forming section;

a driving source assembly body that includes a second driving source for normally and reversely rotating the discharging member; and a both-face printing assembly body that inverts the recording medium pulled-back by reversely rotating the discharging member, and that returns the recording medium to the image forming section, wherein the driving source assembly body and the both-face printing assembly body are separately freely attached and detached with respect to the image forming apparatus main body, and wherein the discharging member comprises an engaging portion, the engaging portion adjustably disposed at a first position and a second position along an axial direction of the discharging member, the engaging portion disengaged from the second driving source and engaged with the first driving source at the first position when the second driving source is detached from the image forming apparatus main body and the engaging portion engaged with the second driving source and disengaged from the first driving source at the second position when the second deriving source is attached to the image forming apparatus main body.

3. The image forming apparatus as claimed in claim 2, further comprising:

a switching unit that performs a switching operation such that the first driving source is connected to the discharging member in a case where the driving source assembly body is not mounted to the image forming apparatus main body, and the second driving source is connected to the discharging member in a case where the driving source assembly body is mounted to the image forming apparatus main body.

4. The image forming apparatus as claimed in claim 3, wherein the switching unit performs the switching operation in accordance with the attachment and detachment of the driving source assembly body.

5. The image forming apparatus as claimed in claim 2, wherein the discharging member has a circumferential speed of a reverse rotating direction derived from the second driving source, the circumferential speed of the reverse rotating direction being faster than the circumferential speed of a normal rotating direction of the discharging member deriving from one of the first driving source and second driving source.

6. The image forming apparatus as claimed in claim 2, wherein the image forming apparatus main body has a first side face and a second side face opposed to the first side face, and the first driving source is arranged on a side of the first side face, and the driving source assembly body is arranged on a side of the second side face.

7. The image forming apparatus as claimed in claim 2, wherein the image forming apparatus main body has a first side face and a second side face opposed to the first side face, and the first driving source and the driving source assembly body are arranged on one of a side of the first side face and a side of the second side face.

8. The image forming apparatus as claimed in claim 7, further comprising:

a driving control section that controls operations of the first driving source and second driving source, wherein the driving control section is arranged on the same side of side face on which the first driving source and the driving source assembly body of the image forming apparatus main body are arranged.

9. The image forming apparatus as claimed in claim 2, wherein the both-face printing assembly body comprises:

a conveying member for both faces that conveys the recording medium; and a third driving source that operates the conveying member for both faces.

10. The image forming apparatus according to claim 9, wherein a conveying speed of a reverse rotating direction of the recording medium using the second driving source is faster than the conveying speed of the recording medium using the third driving source.

11. An image forming apparatus comprising:

an image forming apparatus main body;

an image forming section that is arranged within the image forming apparatus main body, and that forms an image in a recording medium;

a first driving source that is arranged within the image forming apparatus main body;

a discharging member that is rotated in a normal direction by the first driving source, and discharging the recording medium on which the image is formed by the image forming section, the discharging member comprising an engaging portion that is adjustably disposed at a first position and a second position along an axial direction of the discharging member;

a driving source assembly body that includes a second driving source for normally and reversely rotating the discharging member;

a both-face printing assembly body that inverts the recording medium pulled-back by reversely rotating the discharging member, and that returns the recording medium to the image forming section; and a switching unit that performs a switching operation to dispose the engaging portion at the first position such that the first driving source is connected to the discharging member through the engaging portion in a case where the driving source assembly body is not mounted to the image forming apparatus main body, and to dispose the engaging portion at the second position such that the first driving source is disengaged from the discharging member when the second driving source is connected to the discharging member in a case where the driving source assembly body is mounted to the image forming apparatus main body.

12. The image forming apparatus as claimed in claim 11, wherein the switching unit performs the switching operation in accordance with the attachment and detachment of the driving source assembly body.

13. An image forming apparatus comprising:

an image forming apparatus main body;

an image forming section that is arranged within the image forming apparatus main body, and that forms an image in a recording medium;

a discharging member that discharges the recording medium on which the image is formed by the image forming section;

a first driving source that normally rotates the discharging member;

a driving source assembly body that includes a second driving source for normally and reversely rotates the discharging member; and a both-face printing assembly body that inverts the recording medium pulled-back by reversely rotating the discharging member, and that returns the recording medium to the image forming section, wherein the driving source and the both-face printing assembly body being separately mounted to the image forming apparatus main body, and wherein the discharging member comprises an engaging portion, the engaging portion adjustably disposed at a first position and a second position along an axial direction of the discharging member, the engaging portion disengaged from the second driving source and engaged with the first driving source at the first position when the second driving source is detached from the image forming apparatus main body and the engaging portion engaged with the second driving source and disengaged from the first driving source at the second position when the second deriving source is attached to the image forming apparatus main body.

14. An image forming apparatus comprising:

an image forming apparatus main body;

an image forming section that is arranged within the image forming apparatus main body, and that forms an image in a recording medium;

a first driving source that is arranged within the image forming apparatus main body;

a discharging member that is rotated in a normal direction by the first driving source, and that discharges the recording medium on which the image is formed by the image forming section;

a driving source assembly body that includes a second driving source for normally and reversely rotating the discharging member; and a both-face printing assembly body that inverts the recording medium pulled-back by reversely rotating the discharging member, and that returns the recording medium to the image forming section, wherein the driving source and the both-face printing assembly body being separately mounted to the image forming apparatus main body, and wherein the discharging member comprises an engaging portion, the engaging portion adjustably disposed at a first position and a second position along an axial direction of the discharging member, the engaging portion disengaged from the second driving source and engaged with the first driving source at the first position when the second driving source is detached from the image forming apparatus main body and the engaging portion engaged with the second driving source and disengaged from the first driving source at the second position when the second deriving source is attached to the image forming apparatus main body.

15. The image forming apparatus as claimed in claim 13, wherein the both-face printing assembly body is mounted to the image forming apparatus main body, and the driving source is mounted to the image forming apparatus main body separately from the both-face printing assembly body.

* * * * *